US011029135B2

(12) United States Patent
Howe et al.

(10) Patent No.: US 11,029,135 B2
(45) Date of Patent: Jun. 8, 2021

(54) AUTOMATIC METHOD AND APPARATUS FOR LOGGING PREPROGRAMMED ELECTRONIC DETONATORS

(71) Applicant: Austin Star Detonator Company, Cleveland, OH (US)

(72) Inventors: Larry S. Howe, Norwalk, OH (US); Bryan E. Papillon, Phoenixville, PA (US); Pavel Krivanek, Ostrava (CZ); Gimtong Teowee, Westlake Village, CA (US)

(73) Assignee: Austin Star Detonator Company, Cleveland, OH (US)

( * ) Notice: Subject to any disclaimer, the term of this patent is extended or adjusted under 35 U.S.C. 154(b) by 0 days.

(21) Appl. No.: 16/636,448

(22) PCT Filed: Aug. 2, 2018

(86) PCT No.: PCT/US2018/044915
§ 371 (c)(1),
(2) Date: Feb. 4, 2020

(87) PCT Pub. No.: WO2019/028202
PCT Pub. Date: Feb. 7, 2019

(65) Prior Publication Data

US 2020/0173763 A1 Jun. 4, 2020

Related U.S. Application Data

(60) Provisional application No. 62/541,164, filed on Aug. 4, 2017.

(51) Int. Cl.
*F42D 1/05* (2006.01)
*F42D 1/04* (2006.01)
*F23Q 21/00* (2006.01)

(52) U.S. Cl.
CPC ..... *F42D 1/05* (2013.01); *F23Q 21/00* (2013.01); *F42D 1/042* (2013.01)

(58) Field of Classification Search
CPC ..... F42F 1/042; F42F 1/05; F23Q 21/00
USPC ..... 102/206
See application file for complete search history.

(56) References Cited

U.S. PATENT DOCUMENTS 6,085,659 A 7/2000 Beukes et al.
6,789,483 B1 9/2004 Jennings, III et al.
7,054,131 B1 5/2006 Kanth et al.
9,958,247 B2 * 5/2018 Teowee ..... F42D 1/05
(Continued)

OTHER PUBLICATIONS

International Search Report and Written Opinion for PCT/US22018/044915 dated Oct. 18, 2018, 6 pages.
(Continued)

*Primary Examiner* — Bret Hayes
(74) *Attorney, Agent, or Firm* — Fay Sharpe LLP

(57) ABSTRACT

Logging apparatus, methods and electronic detonators are presented for logging data, wherein the logger transmits read request messages to preprogrammed electronic detonators without transmitting any delay programming messaging, receives and stores electronic detonator data from a given one of the preprogrammed electronic detonators, and sends a verify command to cause the detonator to update its status flag to prevent the given electronic detonator from responding to subsequent read request messages.

2 Claims, 4 Drawing Sheets

(56) References Cited

U.S. PATENT DOCUMENTS

2005/0011388 A1 1/2005 Kouznetsov
2005/0011389 A1 1/2005 Teowee et al.
2005/0011390 A1 1/2005 Jennings, III
2005/0011391 A1 1/2005 Jennings, III
2005/0015473 A1 1/2005 Teowee et al.
2005/0034623 A1 2/2005 Jennings, III
2005/0034624 A1 2/2005 Forman et al.
2005/0115437 A1* 6/2005 Jennings, III ..... F42B 3/122 102/206
2005/0131655 A1 6/2005 Moolman et al.
2005/0188871 A1 9/2005 Forman et al.
2005/0190525 A1 9/2005 Jennings, III
2005/0193914 A1 9/2005 Jennings, III
2005/0279238 A1 12/2005 Jennings, III
2006/0162601 A1 7/2006 Kouznetsov
2006/0219122 A1 10/2006 Teowee et al.
2006/0262480 A1 11/2006 Stewart
2006/0266246 A1 11/2006 Teowee et al.
2006/0272536 A1 12/2006 Lownds et al.
2007/0272110 A1 11/2007 Brent et al.
2008/0105154 A1 5/2008 Kouznetsov
2008/0134923 A1 6/2008 Lownds
2008/0236432 A1 10/2008 Teowee
2008/0282925 A1 11/2008 Lownds et al.
2009/0193993 A1* 8/2009 Hummel ..... F42D 3/04 102/215
2009/0283004 A1 11/2009 Teowee et al.
2009/0301332 A1 12/2009 Teowee et al.
2009/0301333 A1 12/2009 Teowee et al.
2009/0314176 A1 12/2009 Lownds et al.
2010/0164296 A1 7/2010 Kurs et al.
2010/0181843 A1 7/2010 Schatz et al.
2010/0181845 A1 7/2010 Fiorello et al.
2010/0201203 A1 8/2010 Schatz et al.
2010/0212527 A1 8/2010 McCaan et al.
2010/0219694 A1 9/2010 Kurs et al.
2010/0231340 A1 9/2010 Fiorello et al.
2010/0237709 A1 9/2010 Hall et al.
2010/0259108 A1 10/2010 Giler et al.
2010/0259110 A1 10/2010 Kurs et al.
2010/0264747 A1 10/2010 Hall et al.
2010/0277121 A1 11/2010 Hall et al.
2010/0308939 A1 12/2010 Kurs
2011/0067591 A1 3/2011 Stewart
2011/0095618 A1 4/2011 Schatz et al.
2012/0042800 A1 2/2012 McCann et al.
2012/0112531 A1 5/2012 Kesler et al.
2012/0112532 A1 5/2012 Kesler et al.
2012/0112534 A1 5/2012 Kesler et al.
2012/0112535 A1 5/2012 Karalis et al.
2012/0112536 A1 5/2012 Karalis et al.
2012/0112538 A1 5/2012 Kesler et al.
2012/0112691 A1 5/2012 Kurs et al.
2012/0119569 A1 5/2012 Karalis et al.
2012/0119575 A1 5/2012 Kurs et al.
2012/0119576 A1 5/2012 Kesler et al.
2012/0119698 A1 5/2012 Karalis et al.
2012/0125218 A1 5/2012 Condit et al.
2012/0138311 A1 6/2012 Stout
2012/0184338 A1 7/2012 Kesler et al.
2012/0223573 A1 9/2012 Schatz et al.
2012/0227608 A1 9/2012 Givens et al.
2012/0228952 A1 9/2012 Hall et al.
2012/0228953 A1 9/2012 Kesler et al.
2012/0228954 A1 9/2012 Kesler et al.
2012/0235501 A1 9/2012 Kesler et al.
2012/0235502 A1 9/2012 Kesler et al.
2012/0235503 A1 9/2012 Kesler et al.
2012/0235504 A1 9/2012 Kesler et al.
2012/0235505 A1 9/2012 Schatz et al.
2012/0235566 A1 9/2012 Karalis et al.
2012/0235567 A1 9/2012 Karalis et al.
2012/0235633 A1 9/2012 Kesler et al.
2012/0235634 A1 9/2012 Hall et al.
2012/0239117 A1 9/2012 Kesler et al.
2012/0242159 A1 9/2012 Lou et al.
2012/0242225 A1 9/2012 Karalis et al.
2012/0248886 A1 10/2012 Kesler et al.
2012/0248887 A1 10/2012 Kesler et al.
2012/0248888 A1 10/2012 Kesler et al.
2012/0248981 A1 10/2012 Karalis et al.
2012/0256494 A1 10/2012 Kesler et al.
2012/0280765 A1 11/2012 Kurs et al.
2012/0313449 A1 12/2012 Kurs et al.
2012/0313742 A1 12/2012 Kurs et al.
2013/0057364 A1 3/2013 Kesler et al.
2013/0125772 A1 5/2013 Backhus et al.
2013/0278073 A1 10/2013 Kurs et al.
2013/0278074 A1 10/2013 Kurs et al.
2013/0278075 A1 10/2013 Kurs et al.
2013/0298795 A1 11/2013 Brent et al.
2013/0300353 A1 11/2013 Kurs et al.
2013/0307349 A1 11/2013 Hall et al.
2013/0334892 A1 12/2013 Hall et al.
2014/0053750 A1* 2/2014 Lownds ..... F42D 5/00 102/313
2014/0084703 A1 3/2014 Hall et al.
2014/0123866 A1 5/2014 Givens et al.
2014/0159652 A1 6/2014 Hall et al.
2014/0175898 A1 6/2014 Kurs et al.
2014/0225449 A1 8/2014 Kurs
2014/0312706 A1 10/2014 Fiorello et al.
2014/0312707 A1 10/2014 Fiorello et al.
2014/0361627 A1 12/2014 Kurs et al.
2015/0069831 A1 3/2015 Kesler et al.
2015/0107478 A1 4/2015 Condit et al.
2015/0236546 A1 8/2015 Kesler et al.
2015/0255994 A1 9/2015 Kesler et al.
2015/0260496 A1 9/2015 Backhus et al.
2016/0028243 A1 1/2016 Schatz et al.
2016/0043571 A1 2/2016 Kesler et al.
2016/0087687 A1 3/2016 Kesler et al.
2016/0187116 A1 6/2016 Teowee et al.
2016/0197489 A1 7/2016 Kurs et al.
2016/0209195 A1 7/2016 Kruger et al.
2016/0301253 A1 10/2016 Kurs et al.
2017/0053737 A1 2/2017 Kurs
2017/0062124 A9 3/2017 Hall et al.
2017/0089680 A1 3/2017 Papillon et al.
2017/0234667 A1* 8/2017 Nair ..... F42D 1/055 102/312

OTHER PUBLICATIONS

Opposition in Chile against corresponding Chilean Patent No. 202000298, Automatic method and apparatus for logging preprogrammed electronic detonators, held by Austin Star Detonator Company, Cleveland, United States, dated Aug. 24, 2020, 7 pages, (with English translation and Certification).
Brochure of Digishot Electronic Initiation System (Apr. 24, 2015), 6 pages.

* cited by examiner

AUTOMATIC METHOD AND APPARATUS FOR LOGGING PREPROGRAMMED ELECTRONIC DETONATORS

REFERENCE TO RELATED APPLICATIONS

The present application claims priority to and the benefit of U.S. Provisional Patent Application No. 62/541,164, filed Aug. 4, 2017 and entitled AUTOMATIC METHOD AND APPARATUS FOR LOGGING PREPROGRAMMED ELECTRONIC DETONATORS, the entirety of which is hereby incorporated by reference.

TECHNICAL FIELD

The present disclosure involves blasting technology in general, and particularly relates to electronic detonators, logging techniques and loggers.

BACKGROUND

In blasting operations, detonators and explosives are buried in the ground, for example, in holes (e.g., bore holes) drilled into rock formations, etc., and the detonators are wired for external access to blasting machines that provide electrical signaling to initiate detonation of explosives. Electronic detonators have been developed which implement programmable delay times such that an array of detonators can be actuated in a controlled sequence. Such electronic detonators typically include an internally stored unique identification number, referred to herein as a detonator serial ID number, and logger devices can be used to program individual electronic detonators with a corresponding delay time according to a blasting plan. Within a given blasting plan, each detonator may be assigned a "detonator number" or "detonator ID", typically corresponding to a given location or position within a blasting site. In many applications, a blasting site can include hundreds or even thousands of electronic detonators located in a large number of holes, which are referred to herein as positions.

Electronic detonator data for a given blasting site is often logged using one or more loggers, which do not include the capability to fire the detonators being logged. In certain contexts the logging may be performed many weeks or months before blasting occurs, and the electronic detonators are often logged one at a time as they are individually connected to the logger device. Logging, moreover, can involve assignment of the detonator ID for a given blasting plan. Certain electronic detonators have been developed, in which logging of electronic detonators may involve an operator connecting each detonator, and pressing buttons or keys on the logger to read the detonator data, which can include the serial ID number, any assigned detonator ID according to a blasting plan, as well as any delay time. Conventional electronic detonator logging can be time-consuming, with the user being required to connect each detonator, interact with the user interface of the logger to initiate individual read operations, as well as any programming and programmed data verification operations, typically involving navigating through prompt screens on the logger. In a large blasting operation having thousands of detonators, conventional logging can take several hours, even where multiple loggers are used.

Thus, conventional electronic detonator logging processes are time-consuming, and thus costly in terms of manpower. Optical scanning of tags or other visible indicia on a detonator is possible, and sometimes quick, but there is no electrical interface in such technology between the logger and the electronics inside the detonator. Moreover, at the end of logging, the detonators cannot be checked electrically to make sure they are all present on a branch line, nor to perform diagnostics where only optical scanning of tag data is used.

Accordingly, there is a need for improved electronic detonator logging techniques and apparatus to facilitate expeditious and safe logging of detonator data.

SUMMARY

Various aspects of the present disclosure are now summarized to facilitate a basic understanding of the disclosure, wherein this summary is not an extensive overview of the disclosure, and is intended neither to identify certain elements of the disclosure, nor to delineate the scope thereof. Instead, the primary purpose of this summary is to present some concepts of the disclosure in a simplified form prior to the more detailed description that is presented hereinafter. Disclosed examples includes logging apparatus, methods and electronic detonators in which the logger transmits read request messages to preprogrammed electronic detonators without transmitting any delay programming messaging, receives and stores electronic detonator data from a given one of the preprogrammed electronic detonators, and the status flag in the given electronic detonator is updated to prevent the given electronic detonator from responding to subsequent read request messages.

BRIEF DESCRIPTION OF THE DRAWINGS

The following description and drawings set forth certain illustrative implementations of the disclosure in detail, which are indicative of several exemplary ways in which the various principles of the disclosure may be carried out. The illustrated examples, however, are not exhaustive of the many possible embodiments of the disclosure. Other objects, advantages and novel features of the disclosure will be set forth in the following detailed description of the disclosure when considered in conjunction with the drawings, in which.

DETAILED DESCRIPTION

Figure 1:
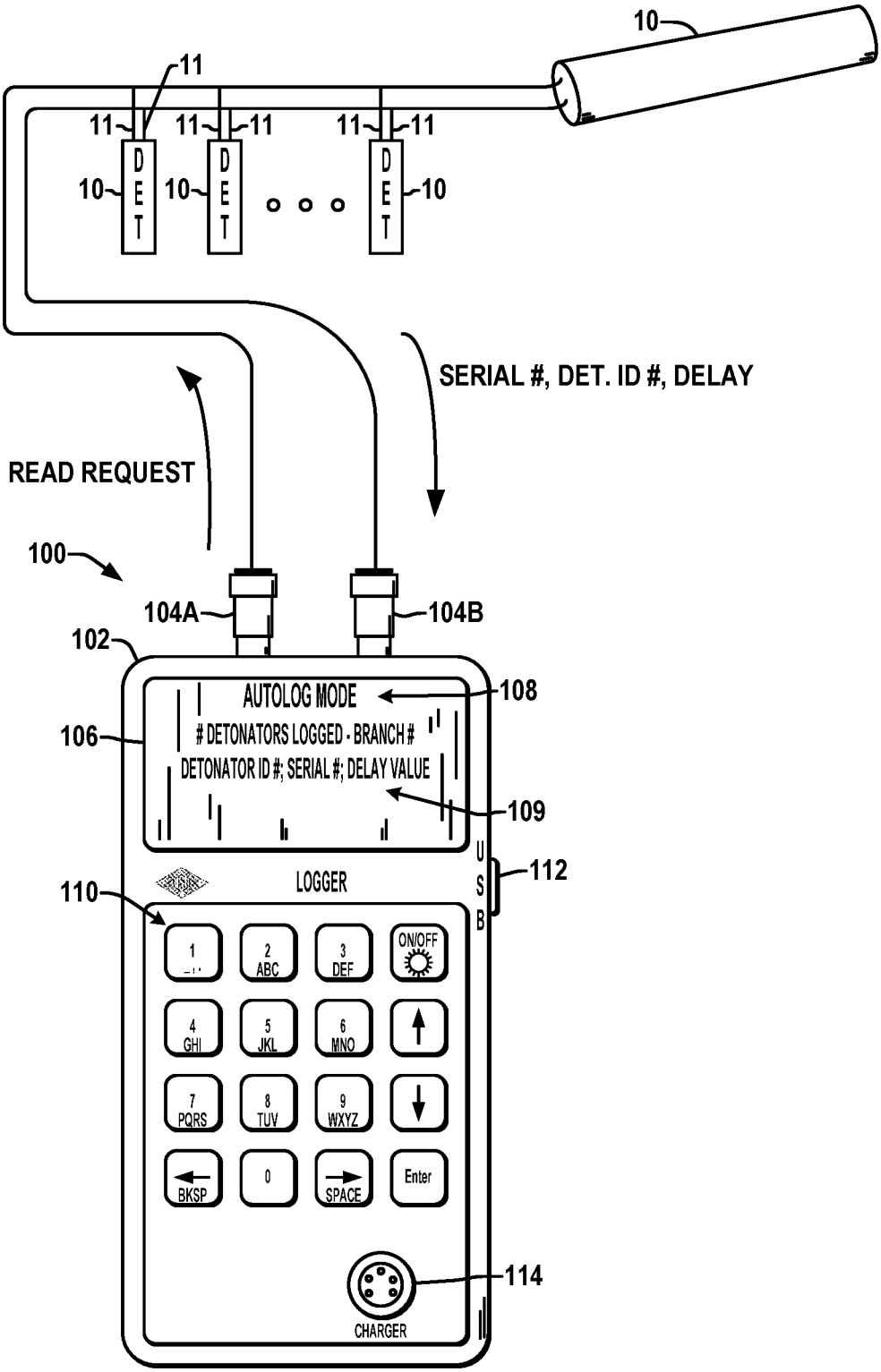
FIG. 1 is a front elevation view illustrating an exemplary logger apparatus for automatically obtaining data from electronic detonators with minimal required user actions to expedite logging in accordance with one or more aspects of the present disclosure.

Referring now to the figures, several embodiments or implementations of the present disclosure are hereinafter described in conjunction with the drawings, wherein like reference numerals are used to refer to like elements throughout, and wherein the various features are not necessarily drawn to scale. The disclosure relates to methods and logger apparatus for safe logging of detonator data and/or for safe programming of electronic detonator delay times.

Figure 2:
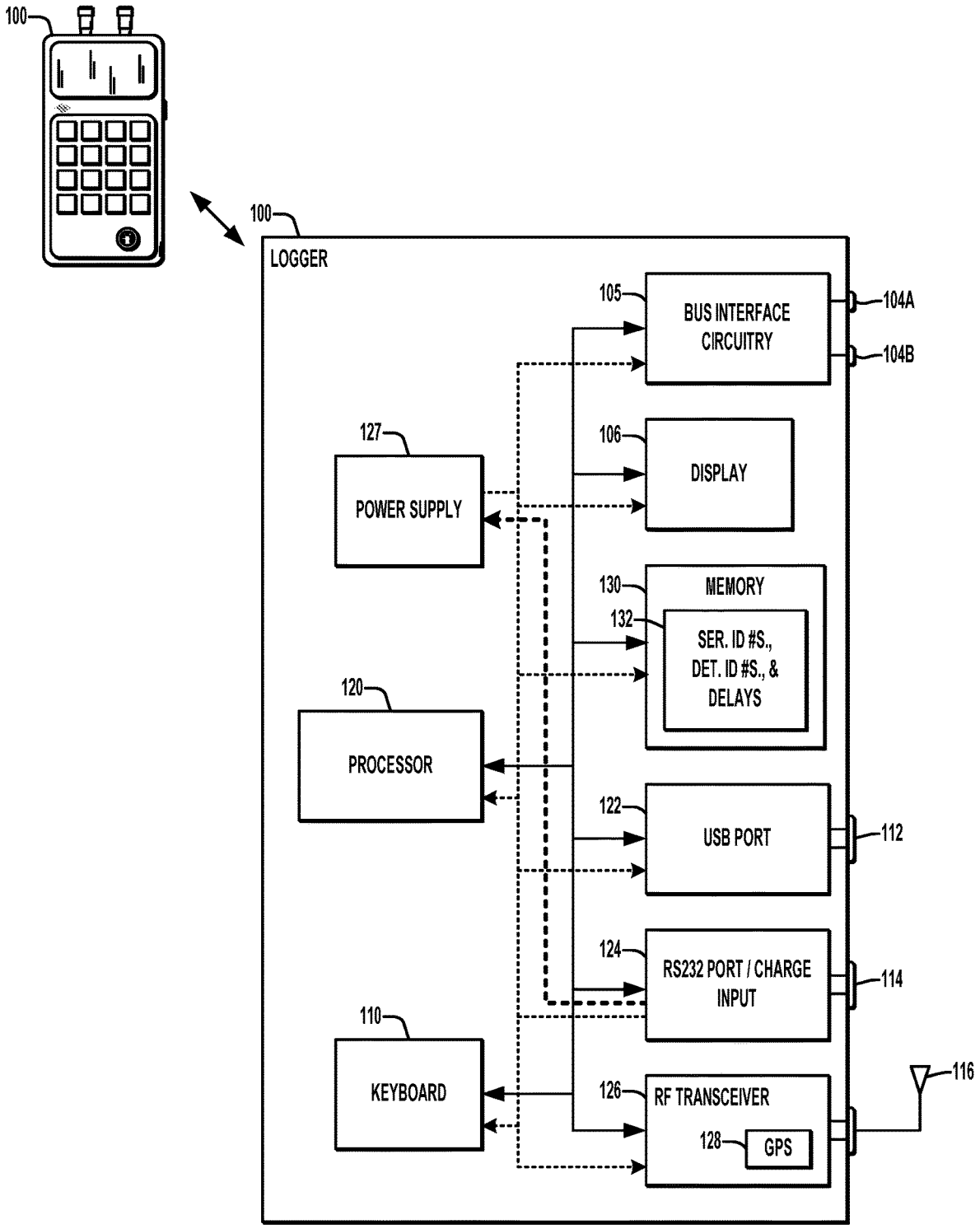
FIG. 2 is a schematic diagram illustrating further details of the exemplary logger of FIG. 1.

Referring initially to FIGS. 1 and 2, an exemplary logger apparatus 100 is shown connected via terminals 104A and 104B to wires 11 of a plurality of preprogrammed electronic detonators 10. The logger 100 includes interface circuitry 105 (FIG. 2) to communicate via suitable electronic messaging for exchanging electronic signaling and data between the logger 100 and the connected detonators 10. The logger 100 may be further adapted to communicate with other loggers and blasting machines (not shown) using conventional communications protocols as are known. In operation, either automatically or through user command, the logger 100 will begin exchanging information with the connected detonators 10. As described further below, the illustrated logger 100 can be placed into a special automatic mode for logging, referred to herein as an automatic logging mode, and the logger 100 in certain examples provides suitable menu-driven options for a user to enter and exit the automatic logging mode. In one possible example, the detonator wires 11 are connected to first and second field terminals 104A and 104B and the logger device 100 is powered on by the user.

The user utilizes one or more buttons on a keypad 110 according to options presented on a display 106 to enter an automatic logging mode ("AUTOLOG"), and the logger 100 is programmed to allow a user to exit this mode via one or more predefined keystrokes. In the automatic logging mode, the logger 100 sends a series of query or "read request" messages in repetitive fashion without requiring the user to otherwise interact with the user interface 106, 110. In this mode, the logger 100 automatically transmits read request messaging via the wires to one or more connected detonators 10, and any previously unlogged detonators 10, if properly connected and functioning, respond with one or more responsive messages or data packets (hereinafter "responsive messaging") including one or more of the detonator's unique serial ID number, any programmed detonator number or detonator ID, and/or any previously programmed delay time value. In the automatic logging mode, if two or more detonators 10 are connected to the wires 11, the logger 100 may detect simultaneous responses from multiple detonators 10, and identify such as "crosstalk", for example, by detecting cyclic redundancy code (CRC) errors in the responsive messaging, and will then retry the read request message until a proper responsive message from a single detonator is received in response. In certain implementations, the logger 100 may discriminate between multiple reply messages from more than one detonator 10 connected to the terminals 104, and can determine the number of detonators 10 with which it is currently connected. In this respect, one possible suitable communication protocol can be implemented with the logger 100 operating as a master for communication along a pair of branch wires with multiple detonators 10 responding to identification request messages and thereafter to messages addressed individually according to the corresponding detonator serial ID numbers. Thus, if the device 100 is connected to a group of detonators 10 in certain modes, it will initially obtain the group of corresponding serial ID numbers from corresponding connected electronic detonators 10.

As shown in FIGS. 1 and 2, the logger 100 includes a housing 102, preferably constructed to withstand the rigors of outdoor blasting site environments while providing externally accessible terminals 104 for connection with detonator wires 11. The logger 100 also includes a display 106 for rendering data and/or images to the user, and a keyboard or other input means 110, and preferably includes an audible annunciator, for example, to provide the user with an audible "beep" sound. In addition, the logger 100 may further include a vibratory indicator operable to selectively provide a vibratory notification to a user, for example, to indicate successful automatic logging and/or automatic programming of a connected detonator 10. The display 106 can be an LCD, LED, OLED, plasma display, fluorescent display, or any other suitable display technology can be used. In practice, due to the environmental nature of blasting operations, the display 106 preferably is able to operate at extreme temperatures such as −20° C. to +70° C. Moreover, the logger device 100 preferably includes a battery allowing field operation. The illustrated logger 100 also includes one or more communication interfaces for exchanging data with external devices, which may include various communications circuits such as a serial port or UART, USB, $I^2C$, SPI, etc. As seen in FIG. 2, for instance, the device 100 may include a USB port 112 with associated circuitry 122 within the housing 102, an externally-accessible RS-232 port connection 114 and associated interior circuitry 124, and/or the logger 100 may include wireless communication transceiver circuitry 126 with an external and/or internal antenna 116. In certain embodiments, moreover, the wireless transceiver 126 may be equipped with a GPS system 128 allowing the logger 102 obtain its current location (e.g., latitude, longitude and/or elevation) by suitable messaging with GPS satellites using known techniques.

The logger 100 in certain embodiments is battery-powered, and the RS-232 port 114 can be used to either connect the logger 100 for data exchange with another logger or other external device (not shown) and/or for charging the internal battery (not shown). In certain embodiments, a nickel cadmium or lithium ion battery, a Ni metal hydride battery or alkaline cells can be used with voltage restrictions consistent with inherently safe or intrinsically safe operation. In other possible embodiments, a lead acid battery may be used. Power can be provided via the charge input 124 from an external device connected to the connector 114 (e.g., five pin connector 114 on the front face of the illustrated logger device 100 in FIG. 1) and provided to charging circuitry within a power supply 127 for charging an internal battery. In addition, the power supply 127 provides suitable AC and/or DC power at one or more levels to drive the various circuitry of the logger 100. In general, the various circuits and components shown in FIG. 2 may be implemented in a single or multiple circuit board configuration with suitable mounting in the interior of the housing 102, and external ports or connections can be provided for the detonator wiring connection terminals 104, a USB port 112, an RS-232 port/charge input connector 114 and/or for any external wireless antenna 116 (in certain embodiments a wireless antenna 116 may be implemented within the interior of the housing 102). Also, suitable electrical connections are provided from such circuit board(s) to the display 106 and to the keyboard 110 for receiving user input by way of key presses.

The logger 100 in certain embodiments is an inherently safe device for use by blasting personnel at a blasting site 200 without danger of accidentally actuating electronic detonators 10. In this regard, the interface circuitry 105 coupled with the detonator wiring terminals 104 in certain embodiments is low-power circuitry and the logger 100 is not provided with suitable power, energy or voltage from the power supply 127 or elsewhere to initiate arming or firing of connected electronic detonators 10. In addition, the logger apparatus 100 and components thereof are generally operated under control of a processor 120 (FIG. 2), and the processor 120 is unable to send any arming or firing commands to connected electronic detonators 10 in the automatic logging and/or automatic programming modes. In other possible embodiments, the logger apparatus 100 may be implemented in a logger or blasting machine, wherein blasting machine implementations need not be inherently safe, but may be operable in a "logger" mode in which the apparatus 100 will not generate sufficient voltage and/or current to cause actuation of an electronic detonator 10 and will not send any arming or firing commands to connected detonators 10.

The processor 120 may be any suitable electronic processing device, including without limitation a microprocessor, microcontroller, DSP, programmable logic, etc. and/or combinations thereof, which performs various operations by executing program code such as software, firmware, microcode, etc. The logger 100 includes an electronic memory 130 which can store program code and/or data, including electronic storage of detonator data 132 such as serial ID numbers, detonator numbers, for instance, corresponding to blast site position numbers, and detonator delay values. In certain embodiments, moreover, the memory 130 can also store corresponding geographic location data, such as latitude, longitude and/or elevation. The memory 130 may be any suitable form of electronic memory, including without limitation EEPROM, flash, SD, a multimedia card, and/or a USB flash drive operatively associated with the USB port 112 (FIG. 1). The memory 130 may store further information, including without limitation additional detonator numbers (a detonator number is a generic number within a blasting plan which is associated with one or more unique detonator serial ID numbers upon logging), a delay time value programmed into the corresponding detonator 10, and/or other status flags to facilitate logger operation. In this regard, the data store or file 130 can include data from detonators 10 logged using many different loggers 300 (FIG. 3), and such logging may be done at different times by different personnel, where some of the logged data in a blasting plan may include geographic location information and others may not. The processor 120 may be programmed to allow a user to access such data for display on the display 106 by using the keyboard 110.

Figure 3A:
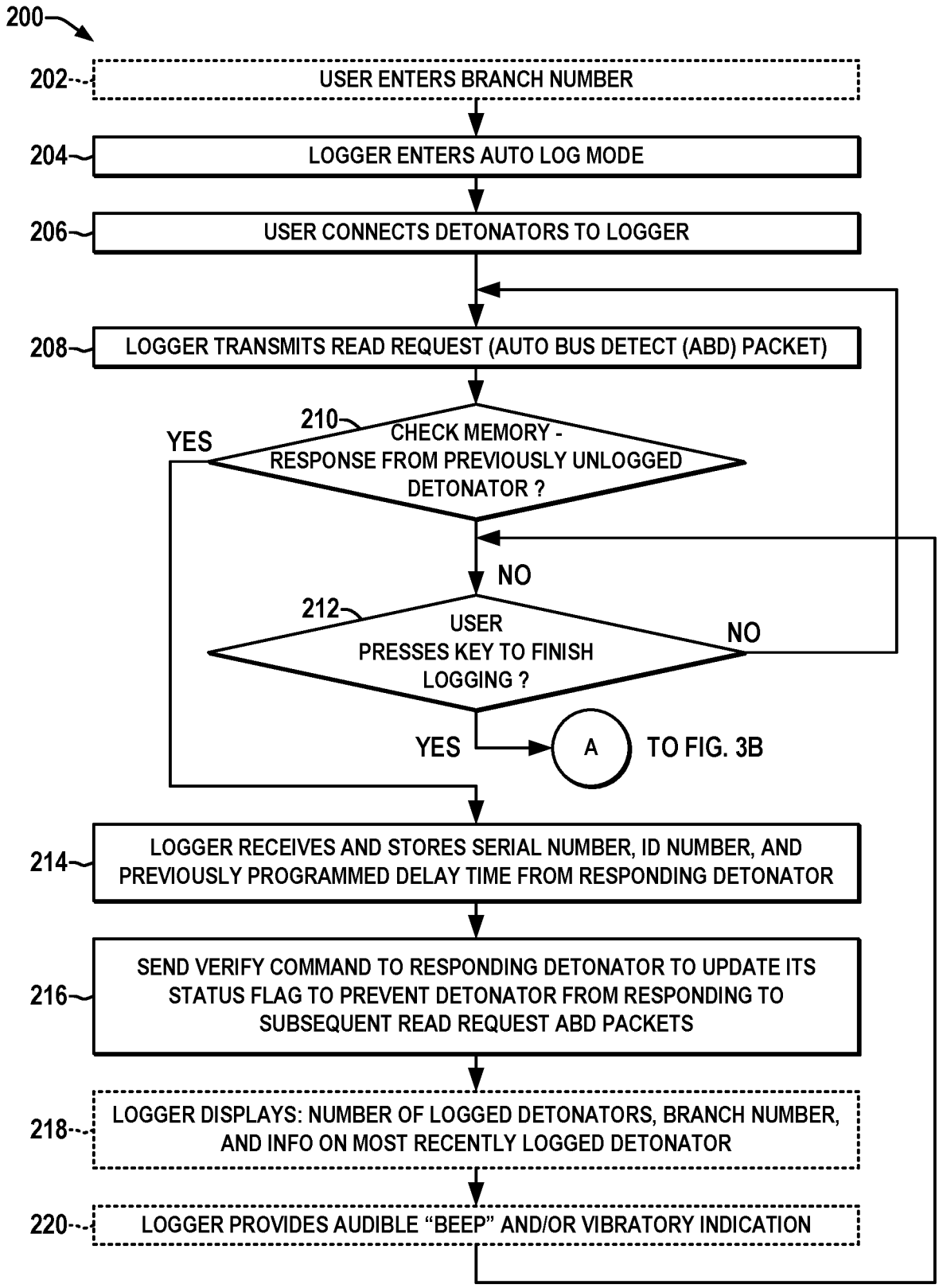
FIGS. 3A and 3B depict a flow diagram illustrating an exemplary method for logging electronic detonators with minimal user interaction according to further aspects of the disclosure.
Figure 3B:
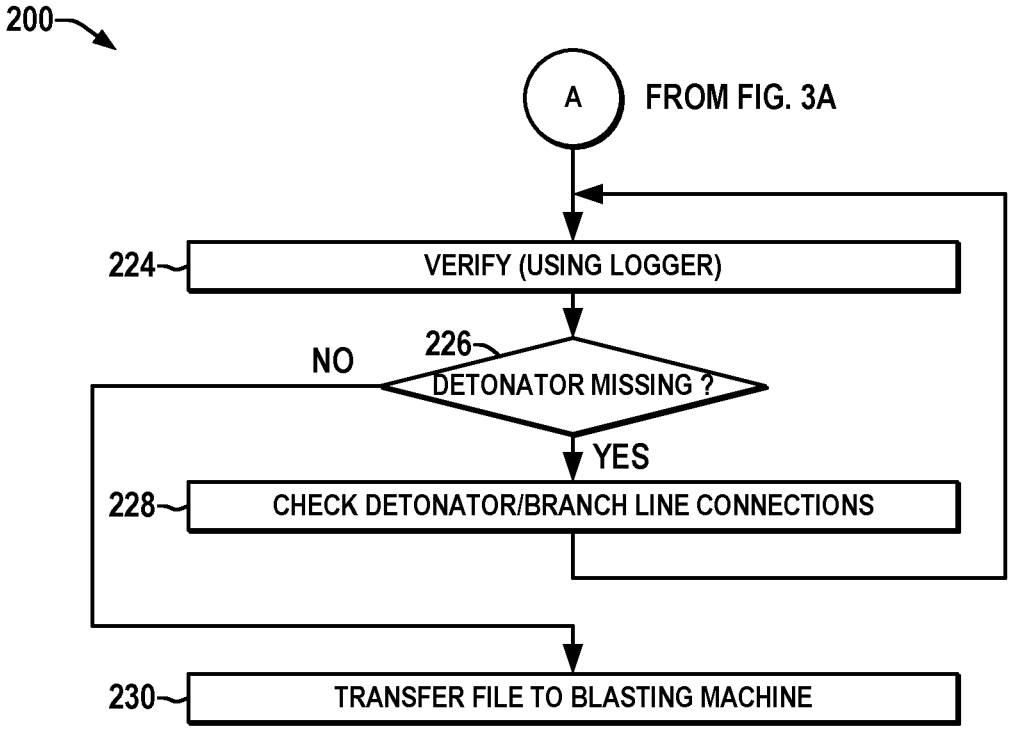

Referring also to FIGS. 3A and 3B, the logger 100 is operable in an automatic logging mode, where FIGS. 3A and 3B illustrate an exemplary logging method 200 which may be implemented using the logger 100 of FIGS. 1 and 2. Although the exemplary method 200 and other methods of this disclosure are illustrated and described hereinafter in the form of a series of acts or events, it will be appreciated that the various methods of the disclosure are not limited by the illustrated ordering of such acts or events. In this regard, except as specifically provided hereinafter, some acts or events may occur in different order and/or concurrently with other acts or events apart from those illustrated and described herein in accordance with the disclosure. It is further noted that not all illustrated steps may be required to implement a process or method in accordance with the present disclosure, and one or more such acts may be combined. The illustrated method 200 and other methods of the disclosure may be implemented in hardware, processor-executed software, or combinations thereof, such as in the exemplary logger 100 described herein, and may be embodied in the form of computer executable instructions stored in a non-transitory computer readable medium (e.g., memory 130 of FIG. 2).

FIGS. 3A and 3B illustrate operation of the logger 100 in an automatic logging mode, in which a user may optionally enter a branch number at 202 (FIG. 3A). The preprogrammed detonators 10 are previously programmed with delay values prior to the illustrated automatic logging by the logger 100. The user utilizes the keypad 110 to enter the automatic logging mode at 204, for example, by pressing a predefined button 110 and/or by actuating a predefined sequence of keystrokes, which may be prompted, in whole or in part, via suitable prompting messages on the display 106 under control of the processor 120. During operation in the automatic logging mode, moreover, the processor 120 may cause the display 106 to render certain information 108 and 109, such as a mode indicator 108 ("AUTOLOG MODE" in FIG. 1) as well as data 109 related to one or more electronic detonators 10 that have been automatically logged, for example, including the number of detonators logged, a current branch number, a detonator ID, a detonator serial number, and a delay value associated with a most recently logged detonator 10.

In the illustrated embodiment, the processor 120 is programmed to maintain the logger 100 in the automatic logging mode until the user interacts with the user interface 106, 110 to exit the automatic logging mode. At 206, the user connects one or more preprogrammed detonators 10 to the logger 100. In one example, to facilitate stopping and restarting the automatic logging process, when automatic logging is started, the logger 100 initially attempts a verification process to verify any previously logged detonators 10 that should already be connected on the bus. This sets status flag (e.g., an internal bus detect bit) in any previously logged detonator(s) 10, preventing the previously logged detonator(s) 10 from responding to an auto bus detect (ABD) command packet. The logger 100 in certain examples also shows if any of the previously logged detonators 10 are now missing from the bus. After the verify process is complete, the logger 100 begins automatic logging using ABD command packets and continues until stopped by operator input. During operation in the automatic logging mode, moreover, the processor 120 operates in a generally continuous or repetitive fashion to issue a series of read request messages at 208 until a response is received from one of a plurality of connected detonators 10. The logger 100 transmits a read request at 208 via the electrical interface 104, 105. While operating in the automatic logging mode, the logger 100 does not transmit any programming messaging to the connected detonator 10, and does not require user interaction with the keyboard 110 or the display 106. This advantageously saves a significant amount of user time in sequentially logging electronic detonators 10, during which time the user does not need to press any buttons on the keyboard 110. The automatic logging mode finds utility in a variety of situations, including without limitation a quality control process in which detonators 10 are preprogrammed by any suitable means, with quality inspection personnel utilizing a logger 100 in the automatic logging mode to log the previously programmed delay for verification with respect to a blasting plan or design timing sequence.

At 210 in FIG. 3A, the logger 100 determines whether a valid detonator response has been received from a previously unlogged detonator 10. If not (NO at 210), the logger determines at 212 whether the user has pressed a key to finish logging. If so (YES at 212), the process 200 proceeds to FIG. 3B as described below. Otherwise (NO at 212), the process 200 returns to 208, where the logger 100 transmits another read request. In the illustrated examples, the logger 100 implements the read request at 208 by sending or transmitting an ABD packet to the connected preprogrammed electronic detonators 10. This command permits the logger 100 to detect any unknown (i.e., unlogged) electronic detonators 10 that are connected to the wires (e.g., bus) 11, forcing such detonators 10 to respond with their serial ID, delay data, scratch data, and current status flag settings. The logger 100 and an ASIC in the individual detonators 10 may preferably be configured and programmed so that this command is used as further described hereinafter.

First, the logger 100 broadcasts an auto bus detect command packet on the wires 11. All detonators 10 receiving the command that have not previously been detected on the wires 11 (as indicated by their respective bus detect status flag settings) calculate a "clock" value that correlates to their serial IDs and/or delay time information, and then enter a wait state. The correlated clock value can, for example, be calculated from an 11-bit number derived from the CRC-8 of the combined serial ID and selected data bits (e.g., 8 bits) of the delay register word of the auto bus detect command packet, so that adequate time is afforded between each possible clock value for the initiation of a response (including any delay as described below) from a corresponding detonator 10. Thereafter, the logger 100 begins issuing a "clock" sequence on the wires 11 that continues (except when halted or aborted as described below) until it reaches a number that correlates to the highest possible detonator serial ID in the system (for example, using the 11-bit number described above, there may be 2,048 possible clock values). Time is allowed between the end of the auto bus detect command packet and issuance of a clock that correlates to the first possible serial ID, to permit calculation by the detonator ASICs of the clock values that correlate to their serial IDs. This can be accomplished by including a wait time (e.g., 10 μs in one embodiment) between the end of the detection command packet and the leading edge of the first transition of the clock. To enable current talkback, the wires 11 are preferably held low during this time, but can alternately be held high. When the clock value for a particular unlogged detonator 10 is reached, the ASIC of that detonator 10 responds. In one example, time (during which the wires 11 are held high or low, preferably low) is permitted for the initiation of a response that is delayed by a predetermined period. The system may preferably be configured so that if the wires 11 are not pulled low before a predetermined timeout period (e.g., 4.096 ms), the detection process will abort.

Upon sensing a response from one or more detonators 10, the logger 100 halts the clock sequence and holds the wires 11 (preferably low) until the full response packet is received, at which point the clock sequence resumes. Alternately, adequate time for the transmission of a full packet could be permitted between the counting of each clock value that correlates to a possible serial ID, however, this would be slower. The logger 100 records at least the serial ID (and optionally also the device settings) of any responding detonators 10. If more than one ASIC begins responding simultaneously, the logger 100 preferably ignores such responses and preferably resumes the clock sequence as it would otherwise. The process starting with the auto bus detect command packet is then repeated using a different delay time or a different dummy serial ID until no unlogged detonators 10 respond (i.e., until a full clock sequence is counted out without any devices responding), at which point it is deemed that all detonators 10 connected to the wires 11 are identified (i.e., logged).

When the auto bus detect sequence is complete, the logger 100 then sends (in any desired order such as by serial ID) a known detonator read back command to each individual known detonator 10, i.e., all those that responded to the auto bus detect command, as well as all those that were initially identified to the logger 100 by the logger. By this command, the logger 100 requests a verify talk back of a single detonator 10 of which the serial ID is known. In response to this command, the detonator 10 provides its serial ID, delay time, scratch information, and status flags (notably including its charge status). This command preferably sets the wires detection flag high so that the device no longer responds to an auto bus detect command.

This operation continues with the logger 100 awaiting responsive messaging from the detonators 10 without transmitting any programming messaging to the connected electronic detonator 10 and without requiring user interaction with the user interface 106, 110. It is noted that the user, at any time, may initiate a mode change in the logger 100, for example, by pressing a dedicated key or a predefined sequence of keys on the keypad 110 in order to take the logger 100 out of the automatic logging mode (YES at 212 in FIG. 3A). Without such mode change, the logger 100 continues issuing read request messages at 208 and 210 until a responsive message or messages is/are received from given one of a plurality of connected electronic detonators 10. As seen in FIG. 3A, the processor 120 is programmed to operate the logger 100 in the automatic logging mode when the plurality of preprogrammed electronic detonators 10 are connected to the electrical interface 104, 105 to cause the logger 100 to transmit one or more read request messages at 208 via the electrical interface 104, 105 without transmitting any delay programming messaging to the connected electronic detonators 10 and without requiring user interaction with the user interface 106, 110. The processor 120 causes the logger 100 to await responsive messaging from a given one of the connected electronic detonators 10 at 210 without transmitting any delay programming messaging to the given detonator 10 and without requiring user interaction with the user interface 106, 110.

At 214, once the logger 100 receives responsive messaging from a previously unlogged given detonator 10 (YES at 210), the logger 100 obtains electronic detonator data 132 from the responsive messaging at 214, and stores this in the memory 130. In one example, the logger 100 receives and stores detonator data, such as one or more of a serial number, and ID number and/or a previously programmed delay time value from the responding given electronic detonator 10 at 214 without transmitting any delay programming messaging to the given electronic detonator 10 and without requiring user interaction with the user interface 106, 110. For each given responding electronic detonator 10, the logger 100 in the illustrated example determines at 210 whether a serial ID number received in responsive messaging from the responding electronic detonator 10 has been previously logged by performing a check of the memory 130. If not, the logger 100 sends a verify command to the given electronic detonator 10 at 216 to cause the detonator 10 to update its status flag, which then prevents the given electronic detonator 10 from responding to subsequent read request messages.

In accordance with further aspects of the present disclosure, the electronic detonators 10 are configured to respond to verify command from the logger 100 and update their status flag, and thereafter to refrain from responding to subsequently received read request messages from the logger 100. In this manner, the system implements the auto logging mode operation to quickly log a plurality of connected preprogrammed electronic detonators 10 without requiring user intervention between loggings. The individual detonators 10 include a pair of wires 11 that allow operative electrical connection of the electronic detonator 10 with the logger 100, and the wires 11 allow exchange of electrical signals between the logger 100 and the electronic detonators 10. As shown in FIG. 1, the interconnection of the wires 11 of the individual detonators 10 and the logger 100 forms a bus configuration. The detonators 10 also include a base charge disposed within the interior of a detonator housing, and an ignition element that is operatively associated with the base charge to selectively ignite the base charge in response to conduction of electrical current through the ignition element. In addition, the individual electronic detonators 10 include an electronic ignition module (EIM) which can include an application-specific integrated circuit (ASIC) that communicates with the logger 100 connected to the wires 11. In operation, the EIM receives the read request message from the logger 100 (e.g., at 216 in FIG. 3A), and in response, transmits the responsive messaging to the logger 100, including at least one of a serial ID number, a programmed detonator ID, and/or a delay value. After transmitting the responsive messaging, the given detonator 10 updates its status flag, and thereafter refrains from responding to subsequently received read request messages from the logger 100.

The logger 100 remains in the automatic logging mode until the user interacts with the user interface (e.g., at 212) In certain examples, after sending the verify command to cause the detonator 10 to update its status flag at 216, the logger 100 returns to check if the user has pressed a user interface key to finish logging at 212, and if not (NO at 212), returns to transmit another read request (ABD packet). In this manner, the logger 100 automatically logs all the connected electronic detonators 10, and obtains previously programmed delay values and other logger data from the connected detonators 10. In certain examples, the logger processor 120 is programmed to cause the logger 100 to provide an audible, vibratory or visual indication to the user via the user interface 106 at 218 and/or 220 indicating that the given electronic detonator 10 has been logged during operation in the automatic logging mode without transmitting any delay programming messaging to the connected electronic detonators 10 and without requiring user interaction with the user interface 106, 110. The logger 100 repeats the automatic logging processing at 208-220 for further ones of the connected preprogrammed electronic detonators 10. The logger 100 stores the received detonator data for each detonator 10 (e.g., serial number, detonator ID number and/or delay time) in the electronic memory 130 at 214 in FIG. 3A, and the logger 100 operates in the auto log mode without transmission of any delay programming messaging to the connected detonator 10 and without requiring user interaction with the user interface 106, 110. Moreover, the logger 100 is incapable of firing the detonator 10, whereby the automatic logging process 200 facilitates expeditious data acquisition from multiple preprogrammed electronic detonators 10 in a safe manner, with little or no user time spent pressing buttons on the keypad 110.

Continuing in FIG. 3B, once the user presses a key to finish logging (YES at 212 in FIG. 3A) the user in a typical implementation connects the logged detonators 10 to a branch line (not shown) at 222, and verifies at 224 (possibly using the same logger 100) that each logged detonator 10 is connected to the branch line. If e.g., any logged detonators are not identified on the branch line (missing detonator determined at 226 "YES"), the user checks the detonator/branch line connections at 228, and again verifies the branch line at 224. If no detonators are missing (NO at 226), the logged data file is transferred to a blasting machine at 230.

The above examples are merely illustrative of several possible embodiments of various aspects of the present disclosure, wherein equivalent alterations and/or modifications will occur to others skilled in the art upon reading and understanding this specification and the annexed drawings. In particular regard to the various functions performed by the above described components (assemblies, devices, systems, circuits, and the like), the terms (including a reference to a "means") used to describe such components are intended to correspond, unless otherwise indicated, to any component, such as hardware, processor-executed software and/or firmware, or combinations thereof, which performs the specified function of the described component (i.e., that is functionally equivalent), even though not structurally equivalent to the disclosed structure which performs the function in the illustrated implementations of the disclosure. In addition, although a particular feature of the disclosure may have been disclosed with respect to only one of several implementations, such feature may be combined with one or more other features of the other implementations as may be desired and advantageous for any given or particular application. Also, to the extent that the terms "including", "includes", "having", "has", "with", or variants thereof are used in the detailed description and/or in the claims, such terms are intended to be inclusive in a manner similar to the term "comprising."

The following is claimed:

1. An electronic detonator, comprising:

a pair of wires to allow operative electrical connection of the electronic detonator with a logger, the wires allowing exchange of electrical signals between the logger and the electronic detonators;

a base charge disposed within the interior of a detonator housing;

an ignition element operatively associated with the base charge to selectively ignite the base charge in response to conduction of electrical current through the ignition element; and an electronic ignition module (EIM), operative to communicate with the logger connected to the wires, the EIM operative to:

receive a read request message from the logger;

in response to receiving the read request message, transmit responsive messaging to the logger, the responsive messaging including at least one of a serial ID number, a programmed detonator ID, and/or a delay value;

after transmitting the responsive messaging, receive a verify command from the logger and update its status flag; and after updating its status flag, refraining from responding to subsequently received read request messages from the logger.

2. The electronic detonator of claim 1, wherein the responsive messaging includes the delay value.

* * * * *